US011703195B2

(12) United States Patent
Elmore et al.

(10) Patent No.: US 11,703,195 B2
(45) Date of Patent: Jul. 18, 2023

(54) WALL PACK LUMINAIRE

(71) Applicant: HLI SOLUTIONS, INC., Greenville, SC (US)

(72) Inventors: Mark Elmore, Easley, SC (US); Jason Duckworth, Simpsonville, SC (US)

(73) Assignee: HLI SOLUTIONS, INC., Greenville, SC (US)

( * ) Notice: Subject to any disclaimer, the term of this patent is extended or adjusted under 35 U.S.C. 154(b) by 0 days.

(21) Appl. No.: 17/348,028

(22) Filed: Jun. 15, 2021

(65) Prior Publication Data

US 2021/0310625 A1 Oct. 7, 2021

Related U.S. Application Data

(63) Continuation of application No. 16/730,012, filed on Dec. 30, 2019, now Pat. No. 11,041,594, which is a continuation of application No. 15/971,516, filed on May 4, 2018, now Pat. No. 10,520,147.

(60) Provisional application No. 62/501,851, filed on May 5, 2017.

(51) Int. Cl.

| | |
|---|---|
| ***F21S 8/00*** | (2006.01) |
| ***F21V 21/02*** | (2006.01) |
| ***F21V 19/00*** | (2006.01) |
| ***F21V 15/01*** | (2006.01) |
| *F21V 29/74* | (2015.01) |

(52) U.S. Cl.

CPC ..... *F21S 8/033* (2013.01); *F21V 15/01* (2013.01); *F21V 19/001* (2013.01); *F21V 21/02* (2013.01); *F21V 29/74* (2015.01)

(58) Field of Classification Search

CPC ..... F21S 8/033; F21V 15/01; F21V 19/001; F21V 21/02; F21V 29/74

See application file for complete search history.

(56) References Cited

U.S. PATENT DOCUMENTS

| | | | |
|---|---|---|---|
| 4,426,676 | A | 1/1984 | Taylor |
| 4,507,719 | A | 3/1985 | Quiogue |
| 8,283,874 | B2 | 10/2012 | Buelow, II |
| 8,342,709 | B2 | 1/2013 | Lueken |

(Continued)

FOREIGN PATENT DOCUMENTS

| | | |
|---|---|---|
| CN | 102032521 | 4/2011 |
| CN | 105650487 | 6/2016 |

(Continued)

OTHER PUBLICATIONS

English Machine Translation of KR20090106024A (Year: 2009).*

(Continued)

*Primary Examiner* — Anne M Hines

(74) *Attorney, Agent, or Firm* — Buckley, Maschoff & Talwalkar LLC

(57) ABSTRACT

A luminaire includes a housing having an outer wall and a mounting wall configured to be secured to a structure. The housing further includes a compartment defined at least partially between the outer wall and the mounting wall. The compartment is configured to support a plurality of control devices. A support is coupled to the housing and supports a light emitter assembly. The support includes a plurality of fins in thermal communication with the light emitter assembly. A wall is positioned between the compartment and the plurality of fins.

20 Claims, 6 Drawing Sheets

(56) References Cited

U.S. PATENT DOCUMENTS

| | | | | |
|---|---|---|---|---|
| 9,016,892 | B1 | 4/2015 | Scribante | |
| 9,109,787 | B2 | 8/2015 | Duckworth et al. | |
| 9,521,727 | B1 | 12/2016 | Clements | |
| 9,523,491 | B2 | 12/2016 | Bailey | |
| 2008/0080196 | A1 | 4/2008 | Ruud | |
| 2009/0120612 | A1 | 5/2009 | Zhang | |
| 2009/0296403 | A1* | 12/2009 | Zhang | F21V 29/773 362/294 |
| 2010/0002432 | A1 | 1/2010 | Romano | |
| 2011/0049749 | A1 | 3/2011 | Bailey et al. | |
| 2012/0087118 | A1 | 4/2012 | Bailey | |
| 2012/0268952 | A1* | 10/2012 | Newton | H05K 13/00 29/854 |
| 2014/0376221 | A1 | 12/2014 | Eliason | |
| 2015/0345772 | A1 | 12/2015 | Duckworth | |
| 2016/0305643 | A1* | 10/2016 | Duckworth | F21V 29/763 |
| 2016/0320035 | A1 | 11/2016 | Duckworth | |
| 2016/0320046 | A1 | 11/2016 | Duckworth et al. | |
| 2017/0299170 | A1 | 10/2017 | Brunelli | |

FOREIGN PATENT DOCUMENTS

| | | |
|---|---|---|
| CN | 206036792 | 3/2017 |
| IT | BS20100103 | 12/2011 |
| KR | 20090106024 A | 10/2009 |
| WO | 2017156268 | 9/2017 |

OTHER PUBLICATIONS

PCT/US2018/031133 International Search Report and Written Opinion dated Jul. 6, 2018 (18 pages).

European Patent Application No. 18794387.3 extended European search repod and search opinion dated Dec. 1, 2020.

Chinese Patent Application No. 201880045047.6 First Office Action issued by the China National Intellectual Property Administration dated Apr. 23, 2021 (and translation).

Chinese Patent Office Action for Application No. 201880045047.6 dated Nov. 10, 2021 (14 pages including partial translation).

* cited by examiner

WALL PACK LUMINAIRE

RELATED APPLICATION(S)

This application is a continuation of U.S. application Ser. No. 16/730,012, filed Dec. 30, 2019, which is a continuation of U.S. application Ser. No. 15/971,516, filed May 4, 2018, which is based on U.S. Provisional Application Ser. No. 62/501,851, filed May 5, 2017, the disclosures of which are incorporated herein by reference in their entirety and to which priority is claimed.

BACKGROUND

The application relates to outdoor luminaires and components for outdoor luminaires.

Light fixtures, or luminaires, include electric light sources to provide an aesthetic and functional housing in both interior and exterior applications. Wall pack luminaires may provide exterior lighting for buildings around walkways and exit doors, and may provide interior lighting near hallways, entryways, or other areas. Wall pack luminaires are typically secured to walls or other structures and provide downward light distribution from an elevated position.

Area lights may include light emitting diodes (LEDs) as a light source in place of conventional incandescent and fluorescent lamps. The use of LEDs results in unique thermal considerations. For example, LEDs and their control components (such as drivers, circuitry, and battery backups) produce more heat than traditional light sources. Moreover, LEDs can degrade over time if exposed to high levels of heat. The internal layout and thermal considerations for each luminaire is unique.

SUMMARY

According to an exemplary embodiment, a luminaire includes a housing having an outer wall and a mounting wall configured to be secured to a structure. The housing further includes a compartment defined at least partially between the outer wall and the mounting wall. The compartment is configured to support a plurality of control devices. A support is coupled to the housing and supports a light emitter assembly. The support includes a plurality of fins in thermal communication with the light emitter assembly. A wall is positioned between the compartment and the plurality of fins.

According to another exemplary embodiment, a luminaire includes a housing having a lower wall, an outer wall and a mounting wall configured to be secured to a structure. The housing further includes a compartment defined at least partially between the outer wall and the mounting wall. The compartment is configured to support a control device. A support is coupled to the housing. The support includes a base, a first set of fins extending from the base away the housing, and a second set of fins extending from the base toward the housing. A light emitter assembly is connected to the support. The light emitter assembly includes a first set of light emitters having a first light distribution and controlled to be deactivated during an emergency mode and a second set of light emitters having a second light distribution and controlled to be activated during an emergency mode.

The above-described and other aspects and features of various exemplary embodiments of the present disclosure will be appreciated and understood by those skilled in the art from the following detailed description and drawings.

Figure 1:
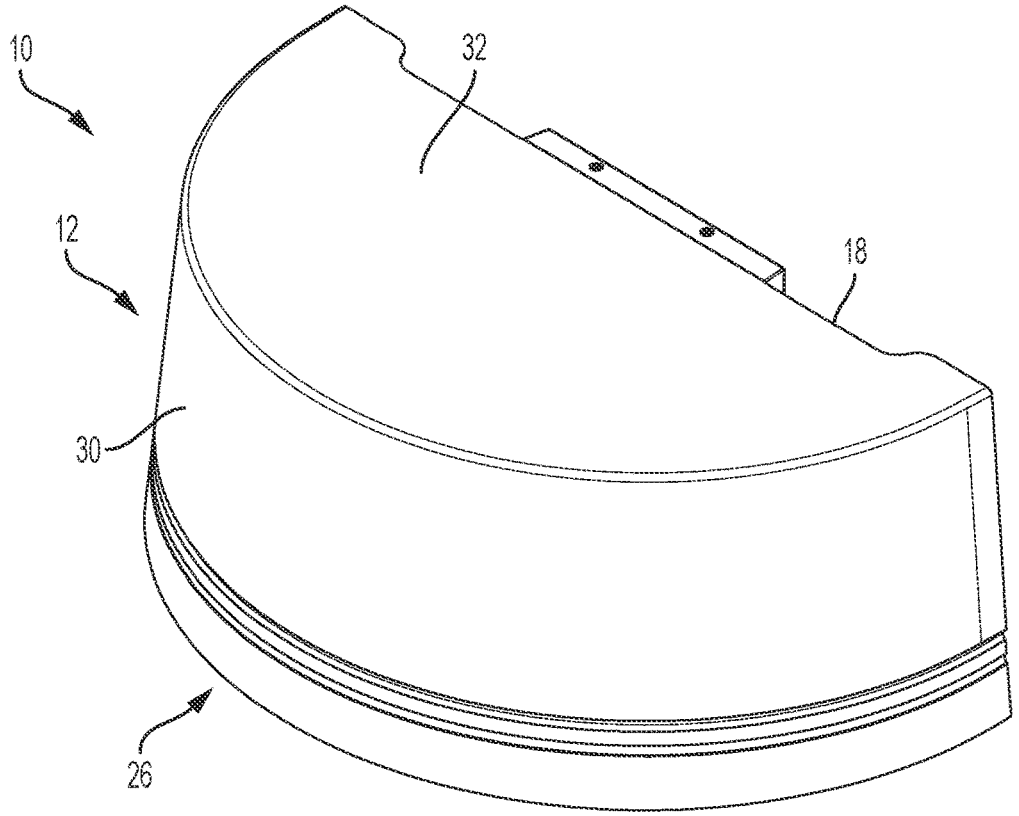
FIG. 1 is an upper perspective view of an exemplary luminaire.

Before any embodiments are explained in detail, it is to be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

DETAILED DESCRIPTION

Various exemplary embodiments of this application are directed to luminaire components that provide a base assembly so that different exterior and interior components can be used with the base components to provide different aesthetic designs, interior controls, and light outputs. For example, common housings and/or mounting features can accommodate different configurations of luminaires that include one or more different types of light emitters, and exterior features such as covers and lenses. The luminaire components also provide efficient thermal management across the range of configurations. This allows customers to customize a luminaire to a desired architectural design within the same product line.

Figure 2:
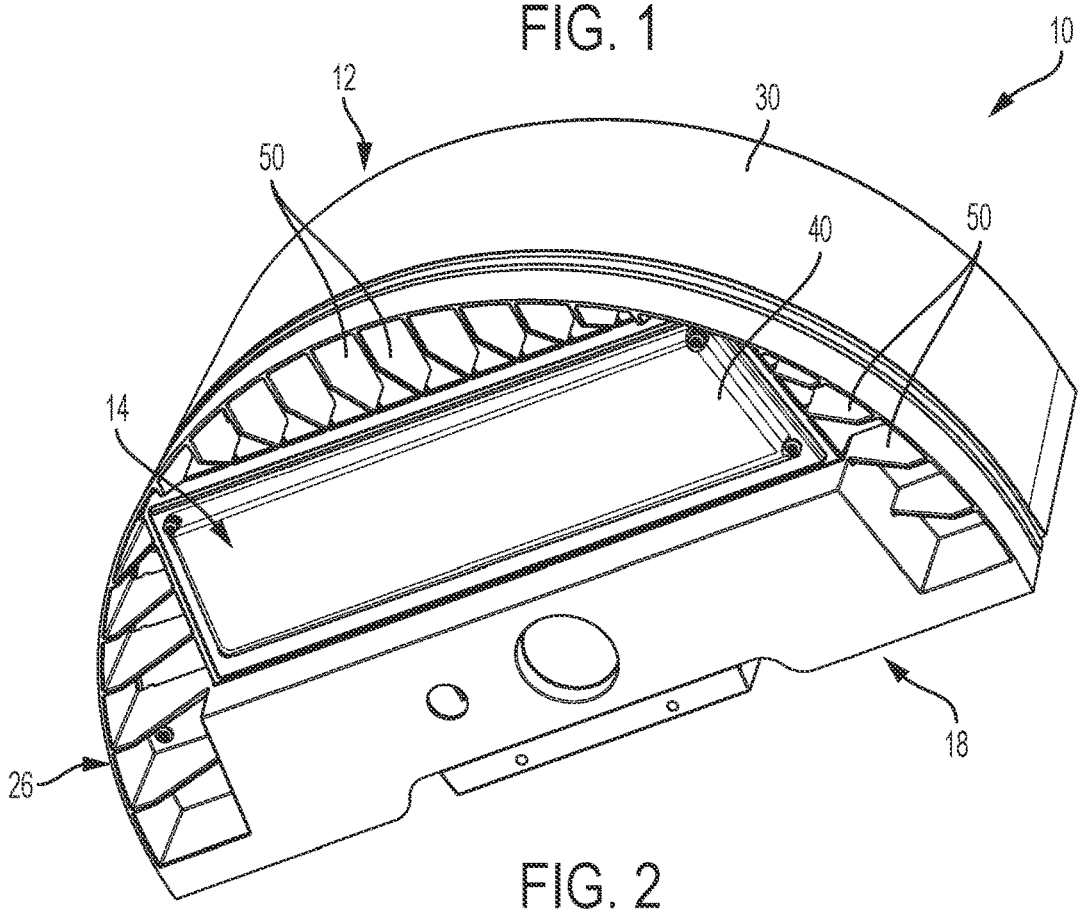
FIG. 2 is a lower perspective view of the luminaire of FIG. 1.

FIGS. 1 and 2 illustrate a wall pack luminaire 10 including a housing 12, a light emitter assembly 14, and a light emitter support 26. In the illustrated embodiment, the housing 12 includes a rear wall or mounting wall 18 configured to connect to a mounting surface (not shown). An outer wall 30 extends outwardly from the mounting wall 18, and an upper wall 32 defines an upper surface of the housing 12.

Figure 5:
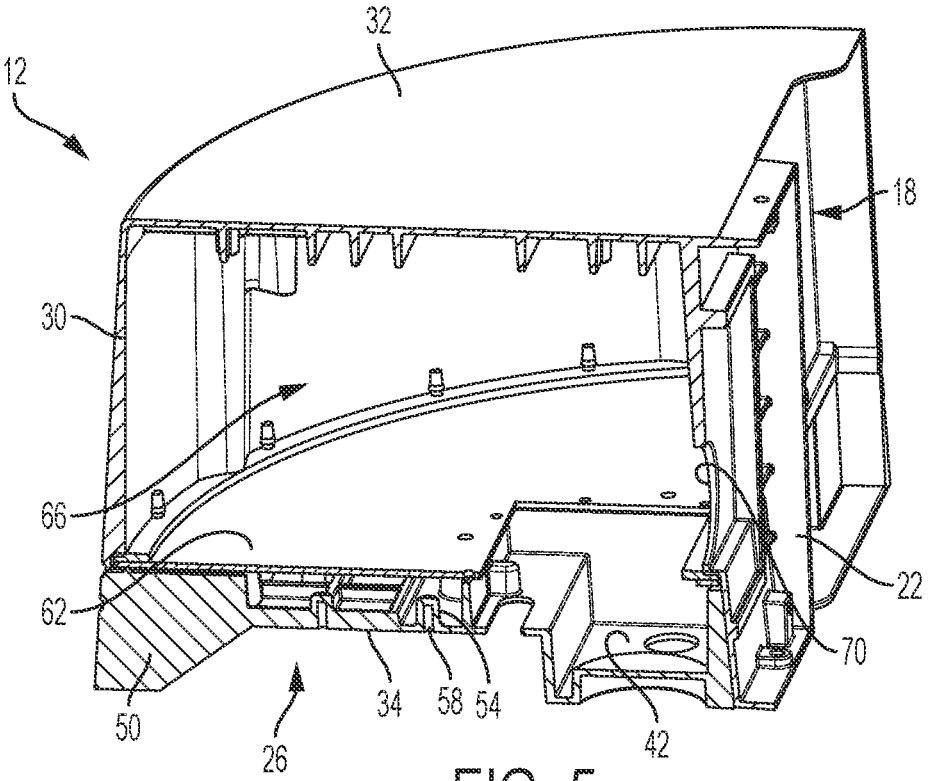
FIG. 5 is a cross-section view of the luminaire of FIG. 1, viewed along section 5-5.

The upper wall 32 may be connected to both the mounting wall 18 and the outer wall 30. The light emitter support 26 may be secured to a lower end of the housing 12 and to the mounting wall 18. Also, the housing 12 may be oriented such that the light emitter assembly 14 is oriented in a downward direction. In the illustrated embodiment, the outer wall 30 has a semi-cylindrical shape. As best shown in FIG. 5, the mounting wall 18 includes flanges 22 for securing the housing 12 to the mounting surface (not shown), and an opening 70 for receiving a power supply conduit (e.g., main power).

Figure 3:
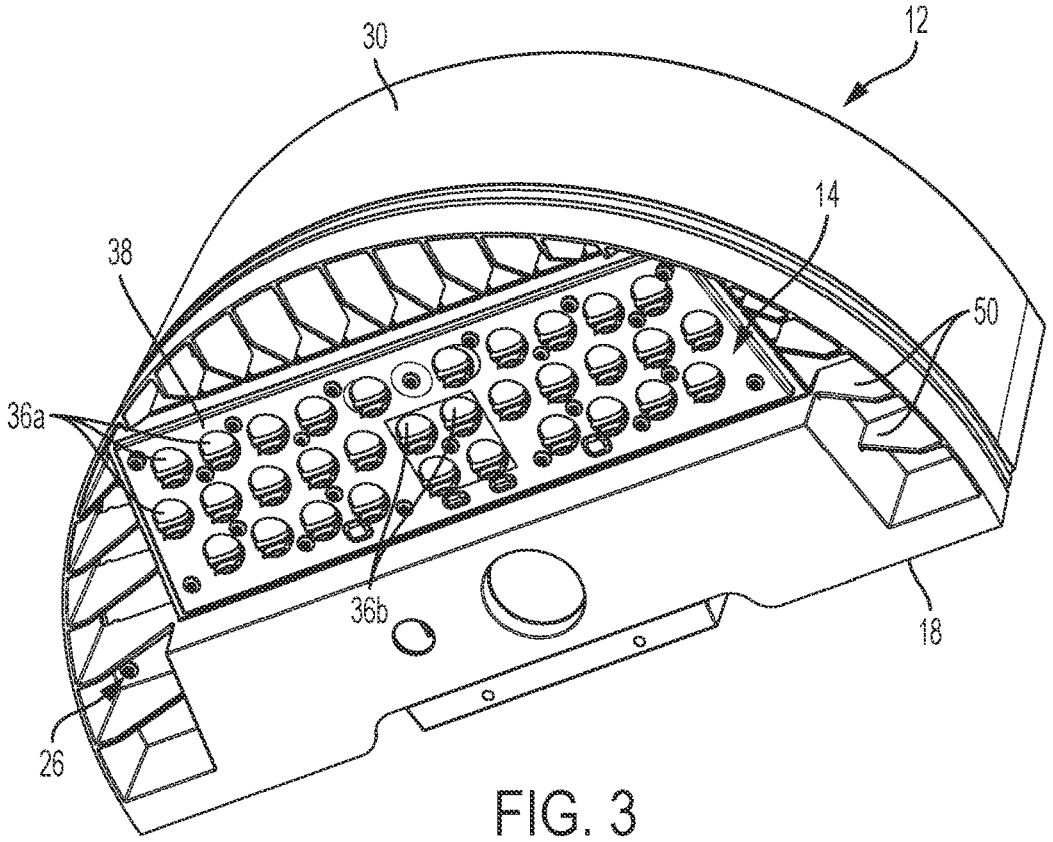
FIG. 3 is a lower perspective view of the luminaire of FIG. 1, with a lens removed.
Figure 4:
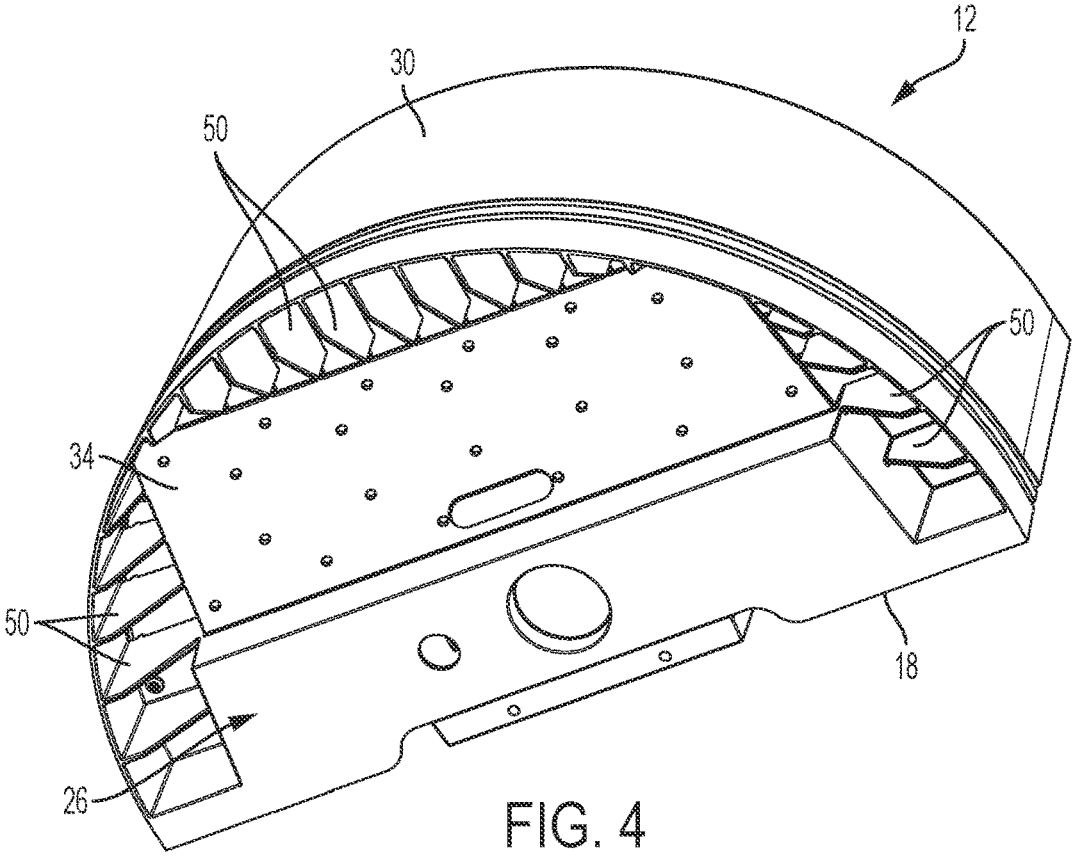
FIG. 4 is a lower perspective view of the luminaire of FIG. 1, with a lens and light emitter assembly removed.

As shown in FIGS. 3 and 4, the light emitter assembly 14 is secured to a lower surface of a base 34 (FIG. 4) of the light emitter support 26. In the illustrated embodiment, the light emitter assembly 14 includes light emitting diodes 36 (LEDs) secured to a substrate or lightboard 38. The light emitter assembly 14 includes a plurality of first LEDs 36*a* and a plurality of second LEDs 36*b*. A first type of lens or optic can be positioned over the first LEDs 36*a* and a second lens or optic can be positioned over the second LEDs 36*b* so that the light distribution from the first LEDs 36*a* is different than the light distribution from the second LEDs 36*b*. An outer lens 40 (FIG. 2) may extend over the LEDs. The outer lens 40 can be translucent to simply provide cover the light emitters, or it can be configured to modify the light output.

In some embodiments, the first LEDs 36*a* and the second LEDs 36*b* may be activated during normal operation, while the second LEDs 36*b* alone are operated in a low-power or emergency mode (i.e., the second LEDs 36*b* may be operated by a backup battery during a loss of mains power). In some embodiments, the second LEDs 36*b* are activated during a lower-power or emergency mode only. A sensor (e.g., an occupancy sensor or ambient light sensor—not shown) may be secured on the light emitter support 26 in a compartment 42 (FIGS. 5 and 6) adjacent the light emitter assembly 14.

The light emitter support 26 includes fins 50 for dissipating heat produced by the LEDs 36 and maintaining a desired operating temperature of the luminaire 10. In the illustrated embodiment, each fin 50 extends orthogonally with respect to the base 34 and extends to the outer wall 30. Stated another way, each fin 50 is oriented either in a direction that is substantially parallel to the mounting wall 18 or in a direction that is substantially perpendicular to the mounting wall 18. In addition, each fin 50 extends downwardly from a plane of the base 34 toward the lower edge of the outer wall 30.

Figure 6:
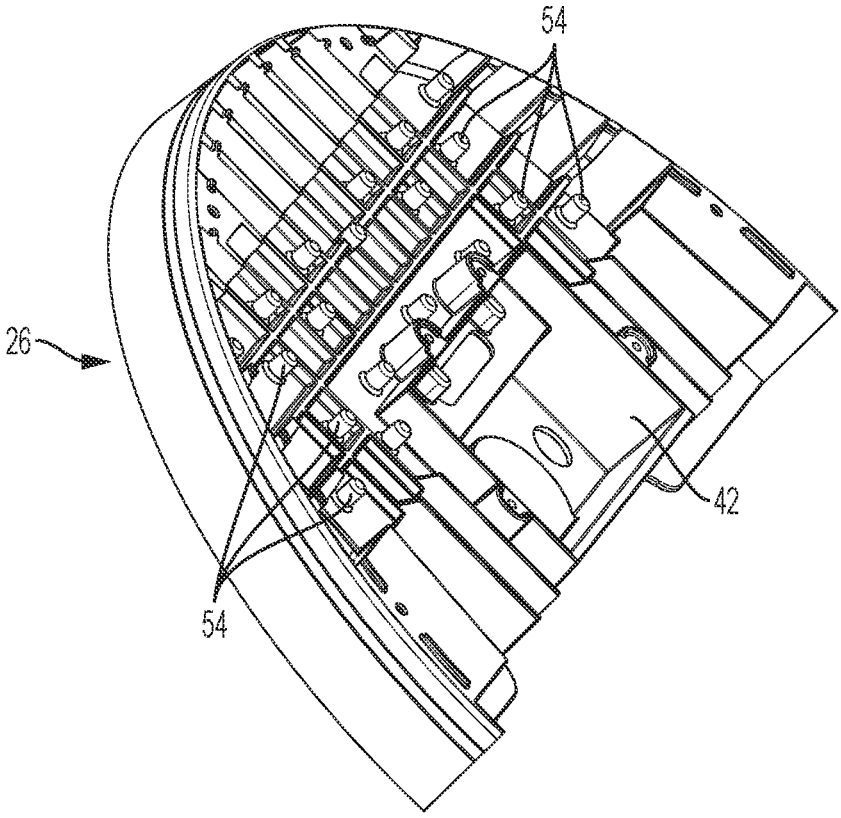
FIG. 6 is a perspective view of a light emitter assembly support.

As shown in FIGS. 5 and 6, an upper surface of the light emitter support 26 includes bosses 54 and a plurality of fastener holes 58 (FIG. 5). Each fastener hole 58 is aligned with corresponding holes in one of the base 34 and a lower wall 62 of the housing 12. Fasteners (e.g., screws) may be inserted through the holes 58 to secure the lightboard 38 to the base 34 and/or to secure the light emitter support 26 to the lower wall 62. As shown in FIG. 5, the housing 12 includes an enclosed compartment 66 defined between the upper wall 32, the lower wall 62, the outer wall 30, and the mounting wall 18. Mounting features (e.g., bosses and holes) allow control components (such as drivers, surge protectors, fuses, batteries, photocells, sensors, wireless communication devices, etc.) to be connected to the housing 12. Other features such as clips or protrusions may be used. The mounting features can directly connect control components or brackets can support and retain various control components in the enclosed compartment 66. Accordingly, the lower wall 62 provides an insulating wall between the control components and the fins 50 and other heat dissipation structures of the light emitter support 26.

Figure 7:
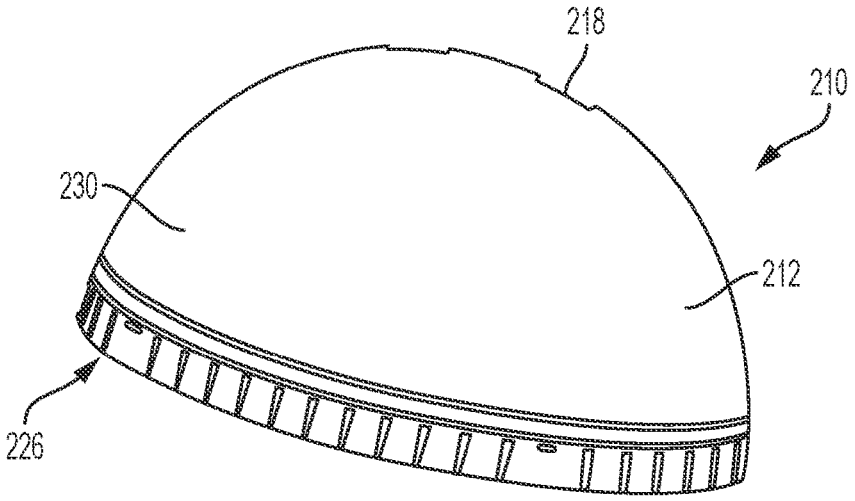
FIG. 7 is an upper perspective view of a luminaire according to another embodiment.
Figure 8:
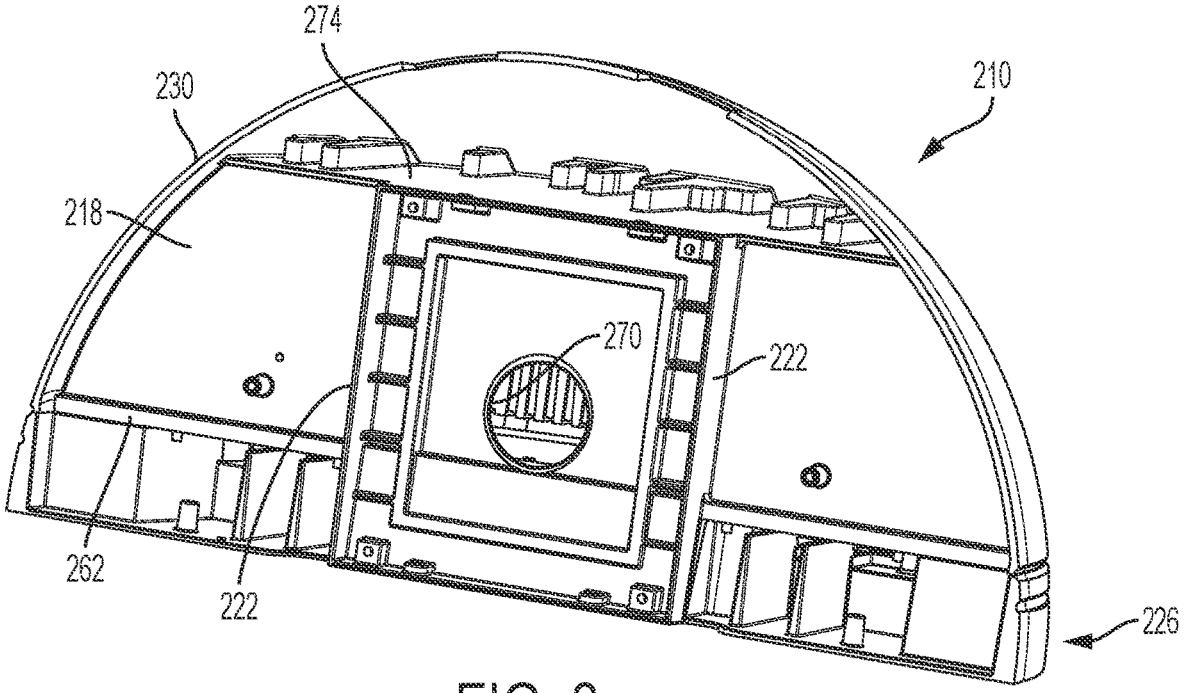
FIG. 8 is rear perspective view of the luminaire of FIG. 7.
Figure 9:
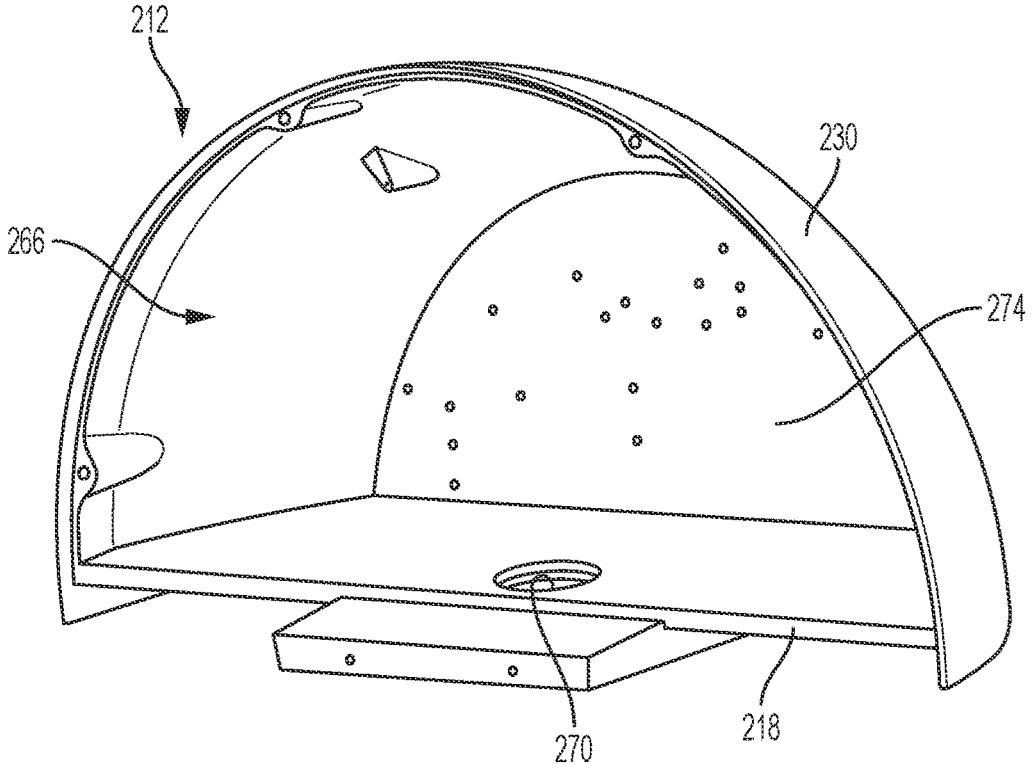
FIG. 9 is a lower perspective view of the luminaire of FIG. 7.

FIGS. 7-9 illustrate a luminaire 210 according to another embodiment. The luminaire 210 is similar to the luminaire 10 described above with respect to FIGS. 1-6, and similar features are identified with similar reference numbers, plus 200. For the sake of brevity, only differences are described in detail.

The luminaire 210 includes a housing 212 including an outer wall 230. The outer wall 230 has a quarter spherical shape. As best shown in FIGS. 8 and 9, the housing 212 includes a compartment 266 that is partially enclosed by a lower wall 262 and an upper interior wall 274. In the illustrated embodiment, the lower wall 262 is formed on a light emitter support 226 (FIG. 8).

Figure 10:
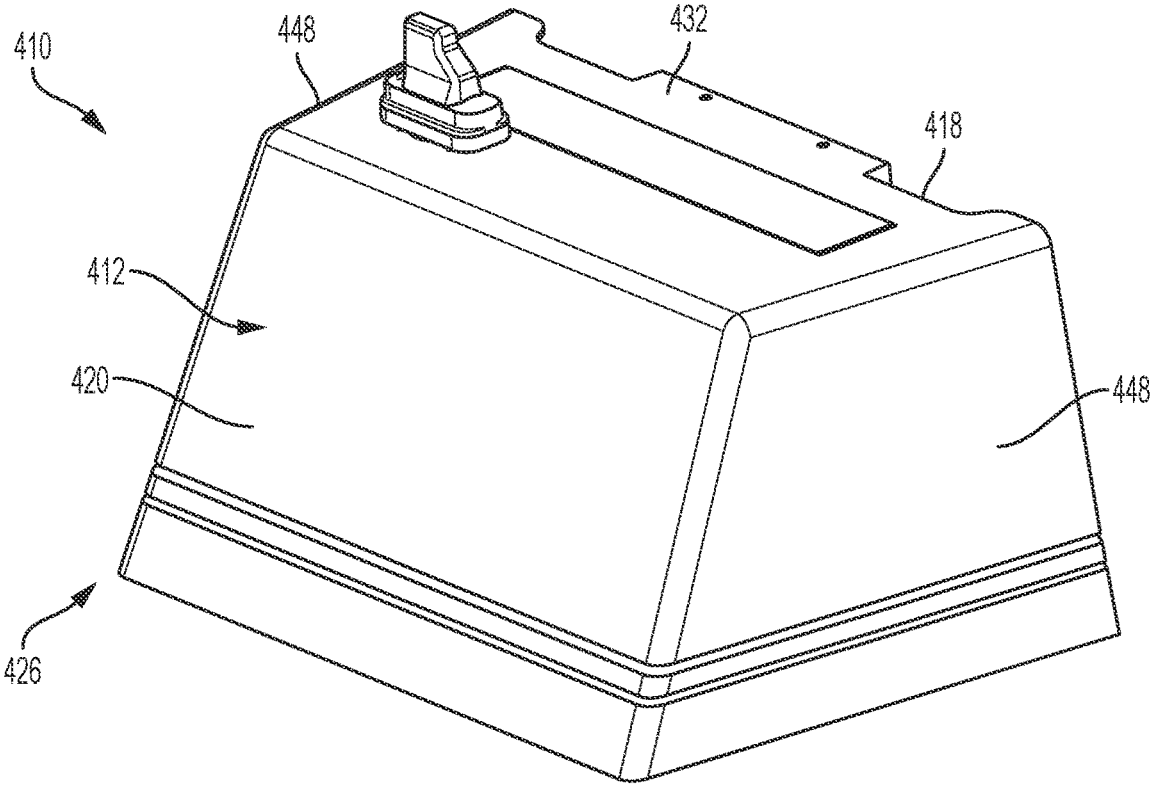
FIG. 10 is an upper perspective view of a luminaire according to another embodiment.
Figure 11:
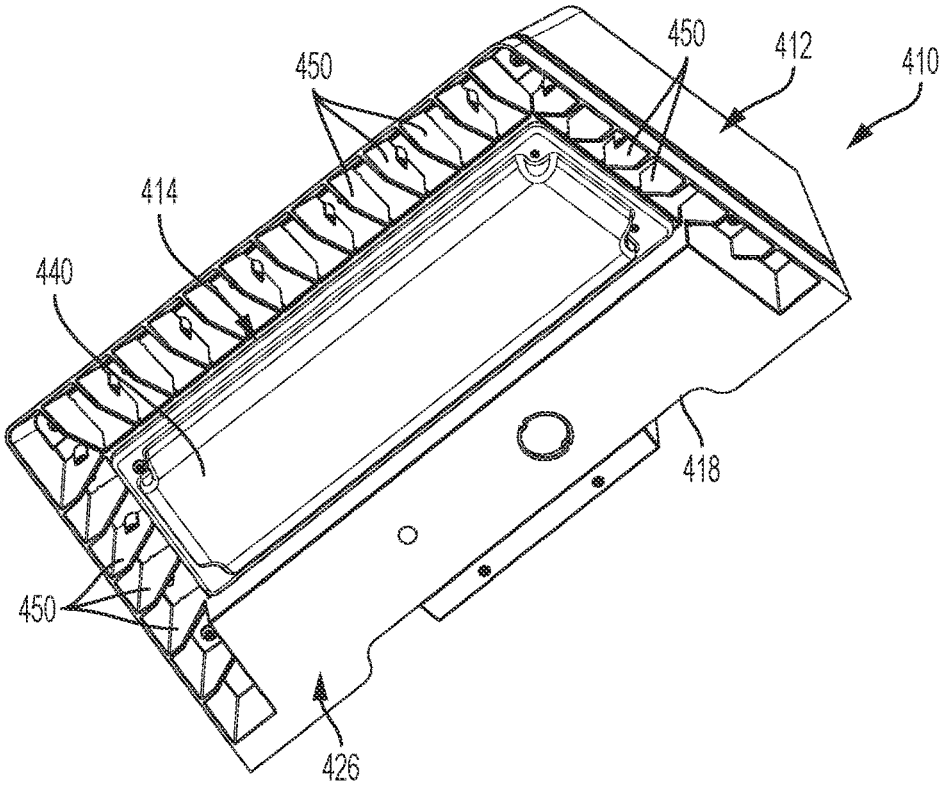
FIG. 11 is a lower perspective view of the luminaire of FIG. 10.
Figure 12:
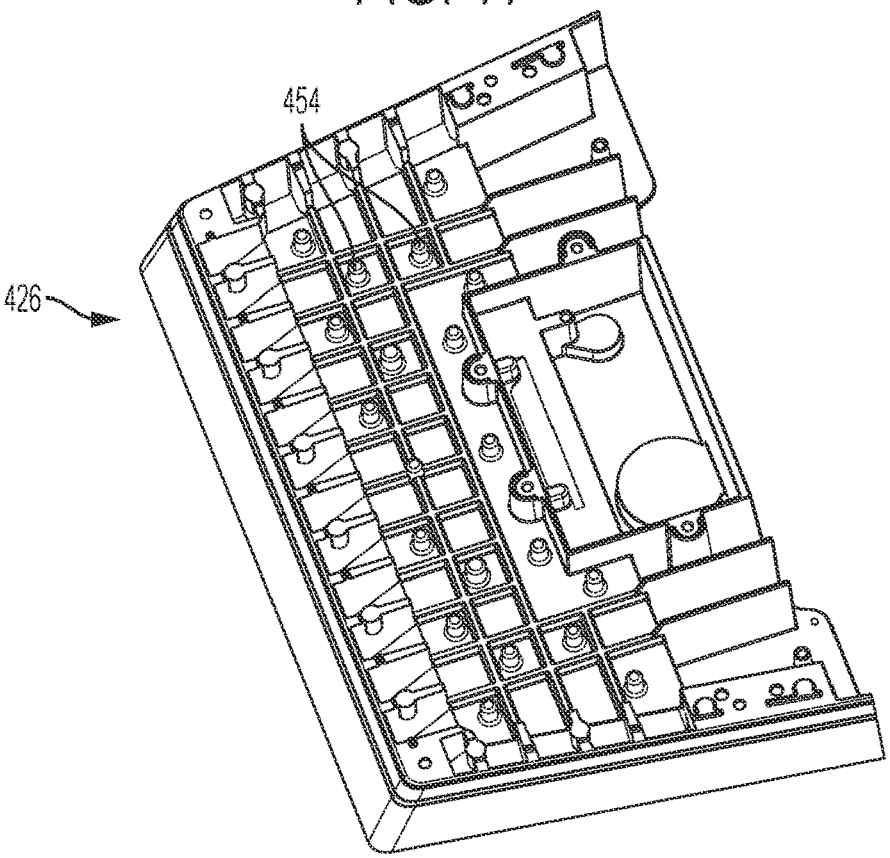
FIG. 12 is a perspective view of a light emitter assembly support.

FIGS. 10-12 illustrate a luminaire 410 according to another embodiment. The luminaire 410 is similar to the luminaire 10 described above with respect to FIGS. 1-6, and similar features are identified with similar reference numbers, plus 400. For the sake of brevity, only differences are described in detail.

The luminaire 410 includes a housing 412 and a light emitter support 426 coupled to a lower end of the upper portion. As shown in FIG. 10, the housing 412 has a mounting wall 418, a front wall 420 opposite the mounting wall 418, an upper wall 432, and side walls 448. The housing 412 defines a generally trapezoidal profile. In addition, as shown in FIG. 11, a light emitter assembly 414 is secured to the light emitter support 426 and includes a lens 440 to provide a desired light distribution. The support 426 includes fins 450, and each fin 50 is oriented either in a direction that is substantially parallel to the mounting wall 418 or in a direction that is substantially perpendicular to the mounting wall 418. In addition, each fin 50 extends downwardly from the plane of the light emitter assembly 414 toward the lower edge of the front wall 420 and side walls 448.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Modifications may be made to adapt a particular situation or material to the teachings of the disclosure without departing from the scope thereof. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A luminaire comprising:

a housing including a first outer wall and a mounting wall configured to be connected to a structure;

a support coupled to the housing, the support including a base, a second outer wall, and a plurality of fins extending between the base and the second outer wall;

a light emitter assembly connected to the base, the light emitter assembly including a first set of light emitters controlled to be deactivated during an emergency mode and a second set of light emitters controlled to be activated during an emergency mode;

a first lens is positioned over the first light emitters having a first light distribution; and a second lens is positioned over the second light emitters having a second light distribution different than the first light distribution.

2. The luminaire of claim 1, wherein the plurality of fins includes a first set of fins oriented in a first direction substantially parallel to the mounting wall and a second set of fins oriented in a second direction substantially perpendicular to the mounting wall.

3. The luminaire of claim 1, wherein the support includes a plurality of bosses and a plurality of holes, the luminaire further comprising a plurality of fasteners for securing the support to the housing, each of the fasteners extending through an associated one of the bosses and holes.

4. The luminaire of claim 1, wherein the first outer wall defines a semi-cylindrical profile.

5. The luminaire of claim 1, wherein the first outer wall defines a quarter-spherical profile.

6. The luminaire of claim 1, wherein the first outer wall defines a trapezoidal profile.

7. The luminaire of claim 1, wherein the plurality of fins extend outwardly and downwardly from the base to draw heat away from the housing.

8. The luminaire of claim 1, wherein the housing includes a compartment defined at least partially between the outer wall and the mounting wall, the compartment configured to support a control device.

9. The luminaire of claim 1, wherein the first set of light emitters at least partially surround the second set of light emitters.

10. The luminaire of claim 1, wherein the second set of light emitters are activated during normal operation.

11. A luminaire comprising:

a housing including a lower wall, an outer wall and a mounting wall, the mounting wall oriented in a vertical direction and configured to be secured to a structure;

a support coupled to the housing, the support including a base, a second outer wall, and a plurality of fins extending between the base and the second outer wall; and a light emitter assembly connected to the base, wherein the light emitter assembly includes a first set of light emitters and a second set of light emitters, wherein the second set of light emitters is positioned between at least two light emitters in the first set of light emitters.

12. The luminaire of claim 11, wherein a first lens is positioned over the first light emitters having a first light distribution and a second lens is positioned over the second light emitters having a second light distribution different than then first light distribution.

13. The luminaire of claim 11, wherein the second set of fins space the base from the housing.

14. The luminaire of claim 11, wherein the plurality of fins includes a first fin oriented in a first direction substantially parallel to the mounting wall and a second fin oriented in a second direction substantially perpendicular to the mounting wall.

15. The luminaire of claim 11, wherein the support includes a plurality of bosses and a plurality of holes, the luminaire further comprising a plurality of fasteners for securing the support to the housing, each of the fasteners extending through an associated one of the bosses and holes.

16. The luminaire of claim 11, wherein the mounting wall includes a conduit for receiving a conductor.

17. The luminaire of claim 11, wherein the outer wall defines a semi-cylindrical profile, a quarter-spherical profile, or a trapezoidal profile.

18. The luminaire of claim 11, wherein the support includes a sensor compartment.

19. The luminaire of claim 11, wherein the housing includes a compartment defined at least partially between the outer wall and the mounting wall, the compartment configured to support a control device.

20. The luminaire of claim 19, wherein a driver is positioned in the compartment and operably connected to the first set of light emitters and the second set of light emitters.

* * * * *